US011203996B2

(12) United States Patent
Hauser et al.

(10) Patent No.: US 11,203,996 B2
(45) Date of Patent: Dec. 21, 2021

(54) FUEL INJECTOR WITH A SOLENOID DRIVE

(71) Applicant: Continental Automotive GmbH, Hannover (DE)

(72) Inventors: Christian Hauser, Lappersdorf (DE); Gerd Rösel, Regensburg (DE); Markus Stutika, Regensburg (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 16/078,776

(22) PCT Filed: Feb. 7, 2017

(86) PCT No.: PCT/EP2017/052658

§ 371 (c)(1),
(2) Date: Aug. 22, 2018

(87) PCT Pub. No.: WO2017/144267

PCT Pub. Date: Aug. 31, 2017

(65) Prior Publication Data

US 2019/0024602 A1 Jan. 24, 2019

(30) Foreign Application Priority Data

Feb. 26, 2016 (DE) ..... 10 2016 203 136.8

(51) Int. Cl.
*F02D 41/20* (2006.01)

(52) U.S. Cl.
CPC ..... *F02D 41/20* (2013.01); *F02D 2041/2055* (2013.01); *F02D 2200/063* (2013.01); *F02D 2200/0616* (2013.01)

(58) Field of Classification Search
CPC ..... F02D 41/20; F02D 41/3005; F02D 2200/0616; F02D 2200/063;
(Continued)

(56) References Cited

U.S. PATENT DOCUMENTS 4,597,368 A * 7/1986 Ament ..... F02D 41/083 123/339.2
5,245,501 A 9/1993 Locher et al. ..... 361/154
(Continued)

FOREIGN PATENT DOCUMENTS

DE 3843138 A1 6/1990 ..... B60T 8/36
DE 102005032087 A1 1/2007 ..... F02D 41/20
(Continued)

OTHER PUBLICATIONS

German Office Action, Application No. 102016203136.8, 5 pages, dated Sep. 22, 2016.
(Continued)

*Primary Examiner* — John Kwon
*Assistant Examiner* — Johnny H Hoang
(74) *Attorney, Agent, or Firm* — Slayden Grubert Beard PLLC

(57) ABSTRACT

In some embodiments, a method includes: setting an actuation time based on a predefined injection quantity; detecting a duration of a resulting closing process; calculating an injection quantity based on the time and the duration; determining the difference of the injection quantity and the predefined quantity; and determining a corrected value of the actuation time based on the difference; and using the corrected value to control further actuation of the fuel injector. The injection quantities and the actuation time are on a characteristic diagram of the relationship between the actuation time, the duration of the closing process, and the injection quantity.

9 Claims, 5 Drawing Sheets

(58) Field of Classification Search
CPC ..... F02D 2041/2055; F02D 2041/2062; F02D 2041/143; F02D 2041/1437; F02M 51/06; F02M 51/0614; F02M 51/0689; F02M 61/04; F02M 61/18; F02M 63/00; F02M 63/0017; F02M 63/0026
USPC ..... 701/101–107, 114, 115; 123/293–299, 123/445, 478, 490
See application file for complete search history.

(56) References Cited

U.S. PATENT DOCUMENTS 5,720,261 A * 2/1998 Sturman ..... F02M 59/105 123/446
9,316,478 B2 4/2016 Wirkowski et al.
9,611,823 B2 4/2017 Schwarte et al.
9,765,723 B2 9/2017 Imai et al.
9,840,981 B2 12/2017 Brandt et al.
2003/0111061 A1* 6/2003 Coldren ..... F02D 41/20 123/514
2004/0172212 A1* 9/2004 Itoh ..... F02D 41/2467 702/127
2008/0006712 A1* 1/2008 Benson ..... F02M 45/083 239/5
2008/0215229 A1* 9/2008 Matsushima ..... F02D 41/047 701/103
2008/0243358 A1* 10/2008 Kojima ..... F02D 35/025 701/102
2012/0239278 A1 9/2012 Becker et al. ..... 701/105
2013/0256430 A1* 10/2013 Terashima ..... F02M 51/0682 239/585.5
2013/0306762 A1* 11/2013 Granger ..... F02M 51/0682 239/585.1
2015/0068494 A1* 3/2015 Robart ..... F02D 41/2467 123/445
2015/0226148 A1* 8/2015 Beer ..... F02D 41/247 123/480
2015/0267670 A1* 9/2015 Nehl ..... F02M 51/0671 239/585.1
2016/0237937 A1* 8/2016 Kusakabe ..... F02D 41/402
2016/0298566 A1* 10/2016 Barth ..... F02D 41/2467
2017/0306907 A1* 10/2017 Namuduri ..... F02D 41/20
2018/0216560 A1* 8/2018 Hauser ..... F02D 41/20
2019/0170075 A1* 6/2019 Satake ..... F02D 41/20

FOREIGN PATENT DOCUMENTS

DE 102007062279 A1 6/2009 ..... F02D 41/40
DE 102009029590 A1 3/2011 ..... F02D 41/20
DE 102010040283 B3 12/2011 ..... F02D 41/20
DE 102010039832 A1 3/2012 ..... F16K 31/02
DE 102010039841 B4 1/2014 ..... F02D 41/00
DE 102013223756 A1 5/2015 ..... F02D 41/38
DE 112014002349 T5 1/2016 ..... F02D 41/02
WO 2017/144267 A1 8/2017 ..... F02D 41/20

OTHER PUBLICATIONS

International Search Report and Written Opinion, Application No. PCT/EP2017/052658, 17 pages, dated Apr. 12, 2017.
Chinese Office Action, Application No. 201780013317.0, 21 pages, dated Sep. 16, 2020.

* cited by examiner

FUEL INJECTOR WITH A SOLENOID DRIVE

CROSS-REFERENCE TO RELATED APPLICATIONS

This application is a U.S. National Stage Application of International Application No. PCT/EP2017/052658 filed Feb. 7, 2017, which designates the United States of America, and claims priority to DE Application No. 10 2016 203 136.8 filed Feb. 26, 2016, the contents of which are hereby incorporated by reference in their entirety.

TECHNICAL FIELD

The present disclosure relates to the technical field of actuating fuel injectors. In some embodiments, there is a method for determining a value of an electrical actuation time for the actuation of a fuel injector with a solenoid drive in order to obtain a predefined injection quantity.

BACKGROUND

In order to inject fuel into a combustion chamber, such as a cylinder for example, a fuel injector such as a solenoid valve or a solenoid injector may be used. A solenoid injector (also called a coil injector) has a coil which generates a magnetic field when current flows through the coil, as a result of which a magnetic force is exerted on an armature so that the armature moves in order to cause opening or closing of a nozzle needle or of a closure element for opening or closing the solenoid valve. If the solenoid valve or the solenoid injector has a so-called idle stroke between the armature and the nozzle needle, or between the armature and the closure element, a movement of the armature does not also lead to a movement of the closure element or nozzle needle immediately, but rather only after a movement of the armature by the magnitude of the idle stroke has been completed.

When a voltage is applied to the coil of the solenoid valve, electromagnetic forces move the armature in the direction of a pole piece or pole shoe. The nozzle needle or the closure element likewise moves (in the case of injectors with an idle stroke, only after the idle stroke has been overcome) owing to mechanical coupling (e.g. mechanical contact) and, with a corresponding shift, opens injection holes for the supply of fuel into the combustion chamber. If current further flows through the coil, the armature and nozzle needle or closure element continue to move until the armature reaches or stops against the pole piece. The distance which is covered here by the nozzle needle until the abutment of the armature against the pole piece is also referred to as needle stroke or working stroke.

In order to close the fuel injector, the exciter voltage which is applied to the coil is switched off and the coil is short-circuited, so that the magnetic force is dissipated. The coil short-circuit causes a reversal of polarity of the voltage owing to the dissipation of the magnetic field which is stored in the coil. The level of the voltage is limited by a diode. The nozzle needle or closure element, including the armature, is moved to the closing position owing to a return force which is provided, for example, by a spring. In this context, the needle stroke is passed through in the opposite direction. In the case of injectors with idle stroke, the latter is also subsequently passed through in the opposite direction.

The time of starting the needle movement on opening of the fuel injector (also known as OPP1) corresponds to the start of the injection, and the time of ending the needle movement on closing of the fuel injector (also known as OPP4) corresponds to the end of the injection. These two times therefore determine the hydraulic duration of the injection. Consequently, for identical electrical actuation, injector-specific temporal variations for the start of the needle movement (opening) and the end of the needle movement (closing) can lead to different injection quantities. Such variations are attributable, in particular, to fabrication tolerances, for example spring force, friction, seat diameter, needle stroke, idle stroke etc.

In order to correct such variations in the injection quantity, in particular in order to equalize the injection quantities of a multiplicity of injectors, it is known to acquire the opening times and closing times, for example by measuring feedback signals. The measurement of the characteristic voltage which is superimposed on the coil current or the voltage, as described in patent application DE 3843138 A1, may be used. It is known here that a feedback signal can be obtained on coil-operated assemblies by using the eddy-current-driven coupling between the mechanism (armature+injector needle) and magnetic circuit (coil+housing+armature+pole piece) to generate signals. The physical effect is based on the speed-dependent self-induction in the electromagnetic circuit as a result of the movement of the armature and of the injector needle. Depending on the movement speed, a voltage, which is superimposed on the actuation signal (characteristic voltage), is induced in the solenoid. Utilization of this effect means that the superposition of the electrical base parameters of voltage or current with the signal change from the needle movement can suitably be separated and then processed further. The characteristic signal form in the voltage or current signal is evaluated relative to the time of occurrence.

The evaluation of the characteristic signal form is problematic primarily for detecting opening. Since the magnetic circuit is typically in the saturated state when opening occurs, the reaction to the magnetic circuit is minimal and therefore can only be detected unsatisfactorily. A possible solution is to change the actuation actively to ensure that the magnetic circuit is not saturated. However, in this context the behavior of the injector changes, which makes subsequent transfer to the standard operating mode necessary, but this operating mode is associated with considerable inaccuracy.

SUMMARY

The teachings of the present disclosure provide an improved and simplified method for determining the opening behavior of a fuel injector, which method permits the injection quantity to be easily corrected. For example, some embodiments include a method for determining a value of an electrical actuation time (TI) for the actuation of a fuel injector (1) with a solenoid drive (3, 4) in order to obtain a predefined injection quantity, the method comprising: selecting (71) a starting value of the electrical actuation time (TI) on the basis of the predefined injection quantity, carrying out (72) an actuation process of the fuel injector (1) with the starting value of the electrical actuation time (TI), detecting (73) a duration (TS) of a closing process during the actuation process of the fuel injector (1) with the starting value of the electrical actuation time (TI), acquiring (74) an injection quantity on the basis of the starting value of the electrical actuation time (TI) and the detected duration (TS) of the closing process, determining (75) a difference between the acquired injection quantity and the predefined injection quantity and determining (77) a value of the electrical actuation time on the basis of the determined difference. The acquisition of the injection quantities and the determination of the value of the electrical actuation time (TI) are carried out using a characteristic diagram (60) which represents a relationship between the electrical actuation time (TI), the time duration (TS) of the closing process and the injection quantity.

Some embodiments also include: carrying out (72) a further actuation process of the fuel injector (1) with the determined value of the electrical actuation time (TI), detecting (73) a further time duration (TS) of a closing process during the further actuation process of the fuel injector (1) with the determined value of the electrical actuation time (TI), acquiring (74) a further injection quantity on the basis of the determined value of the electrical actuation time (TI) and the detected further duration (TS) of the closing process, determining (75) a difference between the acquired injection quantity and the predefined injection quantity, and determining (77) a further value of the electrical actuation time (TI) on the basis of the determined difference.

Some embodiments, also include determining (76) whether the difference is greater than a predetermined threshold value. The determination of the further value is carried out only if the difference is greater than the predetermined threshold value.

In some embodiments, the characteristic diagram (60) comprises a multiplicity of curves, each with a constant injection quantity, wherein the electrical actuation time (TI) is specified along a first axis, and the duration (TS) of the closing process is specified along a second axis.

In some embodiments, the actuation process of the fuel injector (1) is carried out in the ballistic operating mode.

In some embodiments, the actuation process of the fuel injector (1) is carried out in the linear operating mode, the method also comprising: acquiring a value of the needle stroke for the fuel injector, and selecting the characteristic diagram (60) from a multiplicity of characteristic diagrams on the basis of the acquired value of the needle movement.

Some embodiments also include: acquiring the value of an idle stroke for the fuel injector (1), and selecting the characteristic diagram (60) from a multiplicity of characteristic diagrams on the basis of the acquired value of the idle stroke.

As another example, some embodiments include a method for actuating a fuel injector (1) having a solenoid drive (3, 4), the method comprising: obtaining a predefined injection quantity, carrying out the method (70) as claimed in to one of the preceding claims in order to determine a value of an electrical actuation time (TI), and actuating the fuel injector (1) with the determined value of the electrical actuation time (TI).

As another example, some embodiments include an engine controller for a vehicle, which engine controller is configured to perform a method (70) as described above.

As another example, some embodiments include a computer program which, when it is executed by a processor, is designed to carry out the method (70) as claimed described above.

BRIEF DESCRIPTION OF THE DRAWINGS

Further features of various embodiments of the present disclosure can be found in the following exemplary description of example embodiments.

Figure 1:
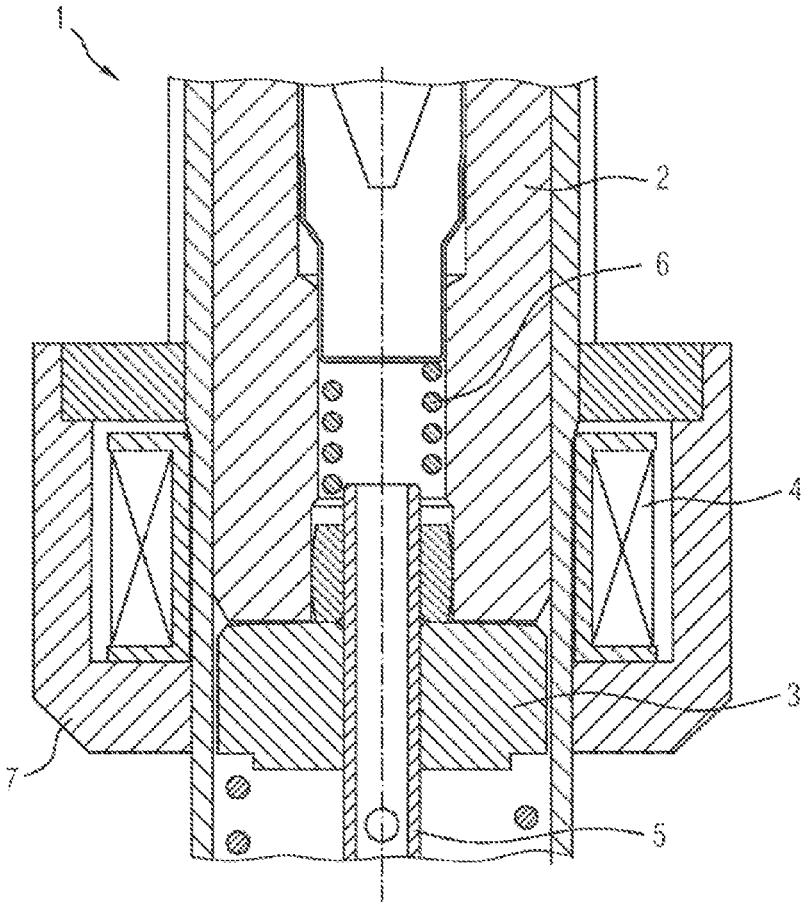
FIG. 1 shows a sectional view of a fuel injector with a solenoid drive, according to teachings of the present disclosure.

It should be noted that the embodiments described are merely a limited selection of possible variant embodiments of the teachings herein.

DETAILED DESCRIPTION

Some embodiments include a method for determining a value of an electrical actuation time for the actuation of a fuel injector with a solenoid drive. In some embodiments, the method comprises the following: (a) selecting a starting value of the electrical actuation time on the basis of the predefined injection quantity, (b) carrying out an actuation process of the fuel injector with the starting value of the electrical actuation time, (c) detecting a duration of a closing process during the actuation process of the fuel injector with the starting value of the electrical actuation time, (d) acquiring an injection quantity on the basis of the starting value of the electrical actuation time and the detected time duration of the closing process, (e) determining a difference between the acquired injection quantity and the predefined injection quantity, and (f) determining a value of the electrical actuation time on the basis of the determined difference, wherein the acquisition of the injection quantities and the determination of the value of the electrical actuation time are carried out using a characteristic diagram which represents a relationship between the electrical actuation time, the closing time and the injection quantity.

The use of a characteristic diagram which represents the relationship between the electrical actuation time, duration of the closing process and injection quantity, for acquiring the injection quantity with a known electrical actuation time and detected duration of the closing process permits easy determination of the electrical actuation time with which a desired hydraulic opening time, and therefore a predefined injection quantity, is obtained. In some embodiments, the injection quantity can therefore be corrected without direct detection of the opening of the fuel injector being required.

In this document, "electrical actuation time" denotes, in particular, the duration for which an electrical voltage (increased boost voltage, followed by holding voltage if appropriate) is applied to the solenoid drive.

In this document, "closing process" denotes, in particular, the process which starts with the switching off of the voltage (boost voltage or holding voltage) and ends with the (hydraulic) closing of the fuel injector.

In some embodiments, the method determines the value of the electrical actuation time at which, given corresponding actuation of the fuel injector, an injection quantity which has been predefined (for example by the engine controller) (and is in accordance with a predetermined hydraulic opening time) is obtained. In some embodiments, the method is initiated by a starting value for the electrical actuation time being selected on the basis of the predefined injection quantity. This selection may use stored data which represent a general relationship between the actuation time and injection quantity for the relevant type of fuel injector. These data are general in the sense that they have been generated on the basis of laboratory tests and/or model calculations for this type of fuel injector. These data can also be adjusted or adapted in combination with other sensors or functions (e.g. lambda control system etc.). Each individual fuel injector of the relevant type consequently has an (actual) relationship between the actuation time and injection quantity which deviates to a greater or lesser extent owing to fabrication tolerances.

The fuel injector is then actuated, wherein the selected starting value of the electrical actuation time is used. In other words, a voltage profile whose duration is equal to the selected value is applied to the solenoid drive of the fuel injector. The voltage profile may start with an increased voltage (boost voltage) which is held until the strength of the current flowing through the solenoid reaches a predetermined value (peak current). Then, the voltage profile has a relatively low voltage (holding voltage). In the case of very small injection quantities it is possible that no holding voltage is used. The closing process is initiated with the switching off of the voltage (boost voltage or holding voltage) and ends with the closing of the fuel injector.

The duration of the closing process is detected during the actuation process of the fuel injector with the starting value of the actuation time. The starting time of the closing process is known, since it corresponds to the switching off of the voltage. The time at which the closing process ends is determined by a suitable method, for example by a detection method mentioned in the introduction above.

An (actual) injection quantity is then acquired on the basis of the starting value of the electrical actuation time and the detected duration of the closing process. This acquisition of the injection quantity is carried out using a characteristic diagram which represents a relationship between the electrical actuation time, duration of the closing process and injection quantity. The characteristic diagram is stored, for example, in a suitable form in a memory of the engine controller.

A difference between the acquired (actual) injection quantity and the predefined injection quantity is then determined, and finally a value (to be used) of the electrical actuation time is determined on the basis of the determined difference. The determination of the value of the electrical actuation time is also carried out using the abovementioned characteristic diagram. In other words, on the basis of the characteristic diagram it is determined how much the electrical actuation time has to be changed in order to reduce the difference between the determined injection quantity and the predefined injection quantity or adjust it to zero. When the fuel injector is subsequently actuated with the value of the electrical actuation time determined by means of the method described, an injection quantity is consequently obtained which is closer to or even equal to the predefined injection quantity.

In some embodiments, the method also comprises the following: (a) carrying out a further actuation process of the fuel injector with the determined value of the electrical actuation time, (b) detecting a further duration of a closing process during the further actuation process of the fuel injector with the determined value of the electrical actuation time, (c) acquiring a further injection quantity on the basis of the determined value of the electrical actuation time and the detected further duration of the closing process, (d) determining a difference between the acquired injection quantity and the predefined injection quantity and (e) determining a further value of the electrical actuation time on the basis of the determined difference.

The method as described above is in principle repeated. More specifically, a further actuation process of the fuel injector is carried out, wherein the determined value of the electrical actuation time is used. In this case, a further duration of the closing process is detected and used together with the determined value of the electrical actuation time as a basis for acquiring a further injection quantity. This is carried out using the same characteristic diagram which was used in the first aspect. Then, a difference between the acquired further injection quantity and the predefined injection quantity is determined, and finally a further value (to be used) of the electrical actuation time is determined on the basis of the determined difference. The determination of the further value of the electrical actuation time is also carried out here using the abovementioned characteristic diagram. During subsequent actuation of the fuel injector with the further value of the electrical actuation time, an injection quantity is consequently obtained which is even closer to or even the same as the predefined injection quantity.

The above steps can be repeated once or several times in order to determine the value to be used for the actuation time in a more precise iterative fashion. In particular, the above steps can be repeated until the determined difference becomes less than a predetermined threshold value.

In some embodiments, the method also comprises determining whether the difference is greater than a predetermined threshold value, wherein the determination of the further value is carried out only if the difference is greater than the predetermined threshold value. In other words, the further value is permitted only if the precision which is predefined by the predetermined threshold value has not yet been achieved.

In some embodiments, the characteristic diagram comprises a multiplicity of curves, each with a constant injection quantity, wherein the electrical actuation time is specified along a first axis, and the duration of the closing process (closing time) is specified along a second axis. In other words, each individual curve in the characteristic diagram corresponds to a determined injection quantity. By virtue of knowledge of two of the variables stored in the characteristic diagram (for example the electrical actuation time and duration of the closing process), it is therefore possible to acquire the third variable (for example the injection quantity). If a combination of the electrical actuation time and duration of the closing process does not lie directly on one of the injection quantity curves, the injection quantity can be determined by interpolation.

In some embodiments, the actuation process of the fuel injector is carried out in the ballistic operating mode. In the ballistic operating mode, the actuation time is so short that the needle does not reach its needle stop. In this case, the opening process and closing process are directly coupled to one another, and the trajectory of the needle is approximately parabolic. The force balance of an injector without an idle stroke, for which in principle only the spring force and the magnetic force determine the trajectory. Therefore, the spring force (and therefore the opening) can be determined by means of the actuation time and closing time. With an idle stroke, the impetus is an additional factor.

In some embodiments, the actuation process of the fuel injector is carried out in the linear operating mode, and the method also comprises the following: (a) acquiring a value of the needle stroke for the fuel injector, and (b) selecting the characteristic diagram from a multiplicity of characteristic diagrams on the basis of the acquired value of the needle movement. In the linear operating mode, the actuation time is so long that the needle reaches its needle stop. In this case, the opening process and closing process are not coupled to one another but rather separated by a holding phase in which the fuel injector is held open.

In such embodiments, the influence of variations on the needle stroke on the duration of the closing process is taken into account (the greater the needle stroke, the longer the duration in otherwise identical conditions) in that a value of the needle stroke for the fuel injector is acquired, and the characteristic diagram is selected on the basis of this value. In other words, a series of characteristic diagrams are stored in the engine controller, wherein each characteristic diagram is assigned to a needle stroke. Alternatively, a correction factor (as a function of the needle stroke) or a characteristic diagram which contains an offset value depending on the needle stroke, can be used.

The value of the needle stroke can also be acquired using various methods. For example, the needle stroke can be acquired by measurement during the mounting of the fuel injector and by adjustment during the service life of the fuel injector by means of a model. The needle stroke can also be determined using a measurement of PSI-I curves (magnetic flux as a function of the strength of the current) during the operation of the fuel injector. A further possibility is to actuate the fuel injector with a special profile during operation and adjustment with a model.

In some embodiments, the method also comprises the following: (a) acquiring the value of an idle stroke for the fuel injector, and (b) selecting the characteristic diagram from a multiplicity of characteristic diagrams on the basis of the acquired value of the idle stroke. In fuel injectors with an idle stroke, variations also occur in the actual idle stroke. Such variations are taken into account in this exemplary embodiment in that the actual idle stroke is acquired and a characteristic diagram corresponding to the value is selected. Alternatively, a correction factor (as a function of the idle stroke) or a characteristic diagram, which contains an offset value depending on the idle stroke, can also be used here.

The value of the idle stroke can also be acquired using various methods. For example, the idle stroke can be acquired by measurement during the mounting of the fuel injector and by adjustment during the service life of the fuel injector by means of a model. The idle stroke can also be determined using a measurement of PSI-I curves (magnetic flux as a function of the strength of the current) during the operation of the fuel injector. A further possibility is to actuate the fuel injector with a special profile during operation and adjustment with a model.

In some embodiments, a method for actuating a fuel injector having a solenoid drive is described. The described method comprises the following: (a) obtaining a predefined injection quantity, (b) carrying out the method according to the first aspect or one of the preceding exemplary embodiments in order to determine a value of an electrical actuation time, and (c) actuating the fuel injector with the determined value of the electrical actuation time. A very precise actuation process of the fuel injector with respect to the obtained injection quantity is made available, which actuation process does not require any complicated method for determining the opening time of the fuel injector.

In some embodiments, an engine controller for a vehicle is described, for using a method according to the first/second aspect and/or any of the above-mentioned exemplary embodiments. This engine controller permits a very precise actuation process of the fuel injector with respect to the injection quantity obtained without complicated and computationally demanding methods for acquiring the opening time of the fuel injector.

In some embodiments, a computer program is designed, when executed by a processor, to carry out the method according to the first or the second aspect and/or one of the above exemplary embodiments. Within the meaning of this document, a computer program of this kind is equivalent to the concept of a program element, a computer program product and/or a computer-readable medium which contains instructions for controlling a computer system, in order to coordinate the manner of operation of a system or of a method in a suitable manner, in order to achieve the effects associated with the method according to the invention.

The computer program can be implemented as a computer-readable instruction code in any suitable programming language, such as JAVA, C++ etc. for example. The computer program can be stored on a computer-readable storage medium (CD-Rom, DVD, Blu-ray disk, removable drive, volatile or non-volatile memory, integral memory/processor etc.). The instruction code can program a computer or other programmable devices, such as in particular a control unit for an engine of a motor vehicle, in such a way that the desired functions are executed. Furthermore, the computer program can be provided in a network such as, for example, the Internet, from which a user can download it as required. Various embodiments may include a computer program, i.e. software, and/or one or more specific electrical circuits, i.e. as hardware or in any desired hybrid form, i.e. by means of software components and hardware components.

Some embodiments are described by way of method claims and other embodiments are described by way of apparatus claims. However, unless explicitly stated otherwise, in addition to a combination of features which are associated with one type of subject matter, any combination of features which are associated with different types of embodiments is also possible.

FIG. 1 shows a sectional view of a fuel injector 1 with a solenoid drive (solenoid injector). The fuel injector 1 has a pole piece 2, a movable armature 3, a coil 4, a nozzle needle 5, a spring 6, and a coil housing 7. The fuel injector 1 has an idle stroke between the armature 3 and nozzle needle 5. When a voltage is applied to the coil 4 which is fitted in the coil housing 7, the armature 3 is moved in the direction of the pole piece 2 by electromagnetic forces. Owing to mechanical coupling, the nozzle needle 5 then likewise moves after overcoming the idle stroke and exposes injection holes for supplying fuel. The armature 3 and the nozzle needle 5 continue to move until the armature 3 strikes the pole piece 2 (needle stroke). In order to close the injector 1, the exciter voltage is disconnected and therefore the magnetic force falls. The nozzle needle 5 and the armature 3 are moved to the closed position by the spring force of the spring 6. The idle stroke and the needle stroke are passed through in reverse order. In fuel injectors without an idle stroke, the idle stroke does not first have to be overcome; in other respects, a fuel injector of this kind is actuated in a similar manner.

Figure 2:
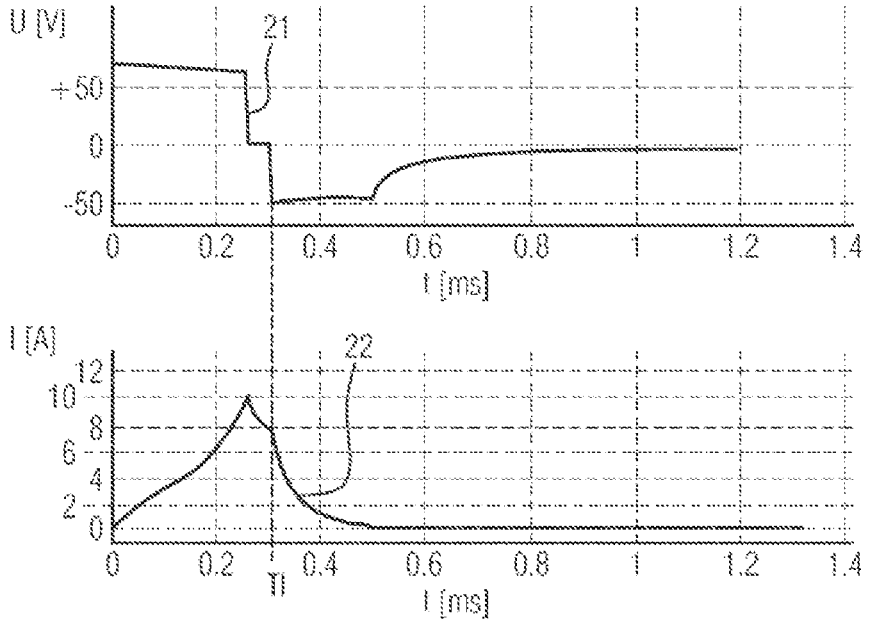
FIG. 2 shows exemplary time profiles of the voltage and current when a fuel injector is actuated, according to teachings of the present disclosure.

FIG. 2 shows exemplary time profiles 21 and 22 of the voltage U and current I when a fuel injector 1 is actuated. The actuation starts at the time t=0 when the boost voltage (for example, approximately 65V) is applied. If the strength of the current I reaches a predetermined maximum value (peak current), in this example 10A, the voltage is reduced up to the end of the electrical actuation time TI (in this example at the time t=0.3 ms). Then, the coil current is reduced and therefore the magnetic force is reduced in proportion therewith. As soon as the forces acting in the closing direction are higher than those acting in the opening direction, the needle begins to close.

Figure 3:
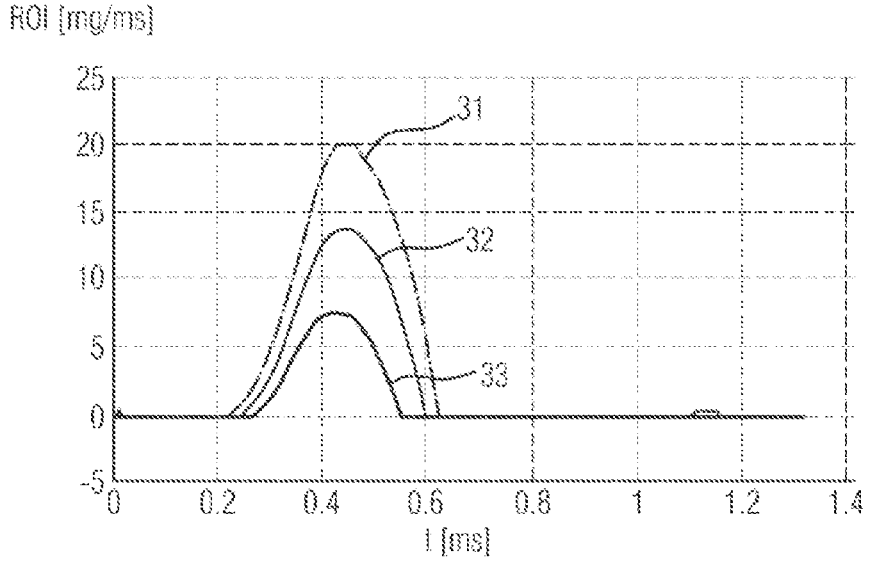
FIG. 3 shows exemplary time profiles of the respective injection rates for fuel injectors with different spring forces (with identical actuation), according to teachings of the present disclosure.

FIG. 3 shows exemplary time profiles 31, 32 and 33 of the respective injection rates ROI of the fuel injectors 1 without an idle stroke and with different spring forces 6, wherein the fuel injectors 1 are all actuated in the same way, for example with the electrical actuation time of TI=0.3 ms shown in FIG. 2.

The profile 31 corresponds to a fuel injector 1 in which the spring 6 has a relatively small spring force. The profile 32 corresponds to a fuel injector 1 in which the spring 6 has a relatively large spring force. The profile 33 corresponds to a fuel injector 1 in which the spring 6 has an even larger spring force. From FIG. 3 it is apparent (cf. profile 31) that the fuel injector 1 with the smallest spring force (ROI>0) opens first and closes last. In a similar way, the profile 33 shows that the fuel injector 1 with the largest spring force opens last and closes first. The opening of the fuel injector 1 with the medium spring force (cf. profile 32) lies between the opening of the fuel injector with the smallest spring force (profile 31) and the opening of the fuel injector 1 with the largest spring force (profile 33). In a similar way, the closing of the fuel injector 1 with the medium spring force (cf. profile 32) lies between the closing of the fuel injector with the largest spring force (profile 33) and the closing of the fuel injector 1 with the smallest spring force (profile 31).

In summary, given identical actuation of injectors without an idle stroke the following relationship is obtained: injectors with a small spring force have an early opening time and a late closing time, and this is correspondingly reversed in injectors with a large spring force.

Figure 4:
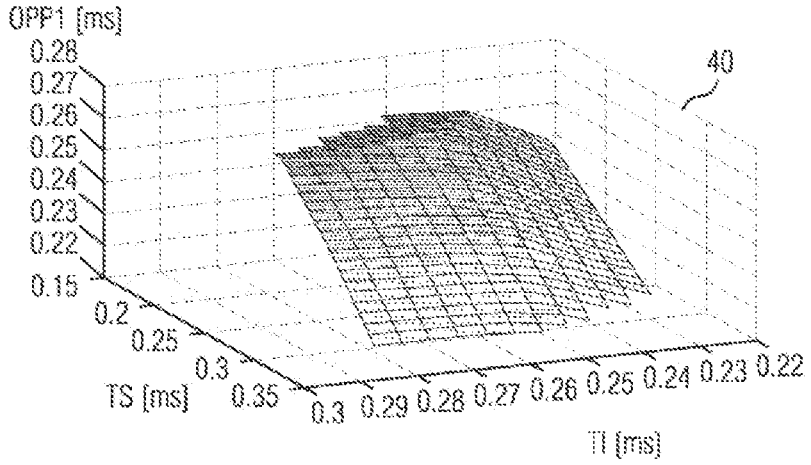
FIG. 4 shows a three-dimensional illustration of a relationship between the actuation time, closing time and opening time, according to teachings of the present disclosure.

FIG. 4 shows a three-dimensional illustration 40 of a relationship between the actuation time TI, closing time TS and opening time OPP1. The relationship shown in FIG. 4 was acquired on the basis of numerous measurements (with varying actuation times TI) on a multiplicity of fuel injectors (with various spring forces).

Figure 5:
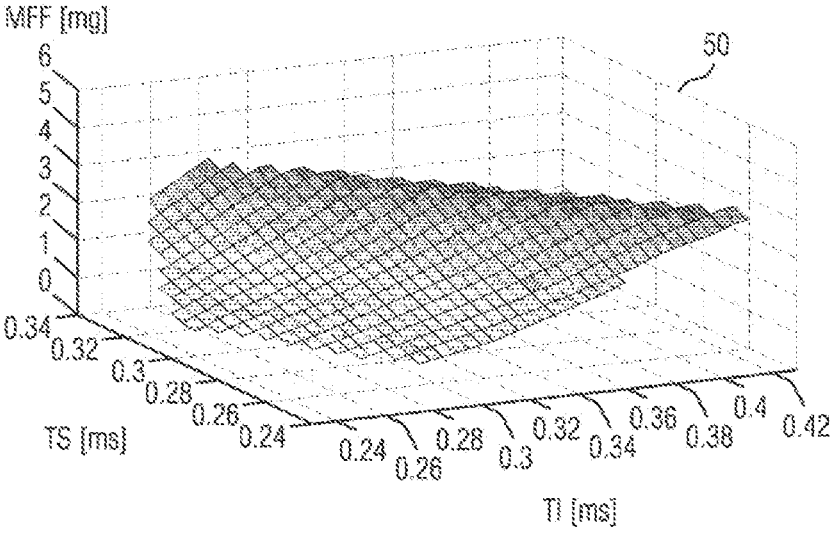
FIG. 5 shows a three-dimensional illustration of a relationship between the actuation time, closing time and injection quantity, according to teachings of the present disclosure.

FIG. 5 shows a three-dimensional illustration 50 of a relationship between the actuation time TI, closing time TS and injection quantity MFF. The relationship 50 shown in FIG. 5 was derived from the relationship 40 shown in FIG. 4. For this purpose, use was made of the fact that the hydraulic opening time decisively determines the fuel quantity which is output. The hydraulic opening time is determined by the time difference between the closing time (OPP4) and the opening time (OPP1). Since both times are now known (OPP4 is directly linked to the closing time), OPP1 in the illustration 40 can be replaced by the fuel quantity MFF. Therefore, a uniquely defined relationship 50 between the known TI and the measured TS is obtained again for the determination of the quantity.

Figure 6:
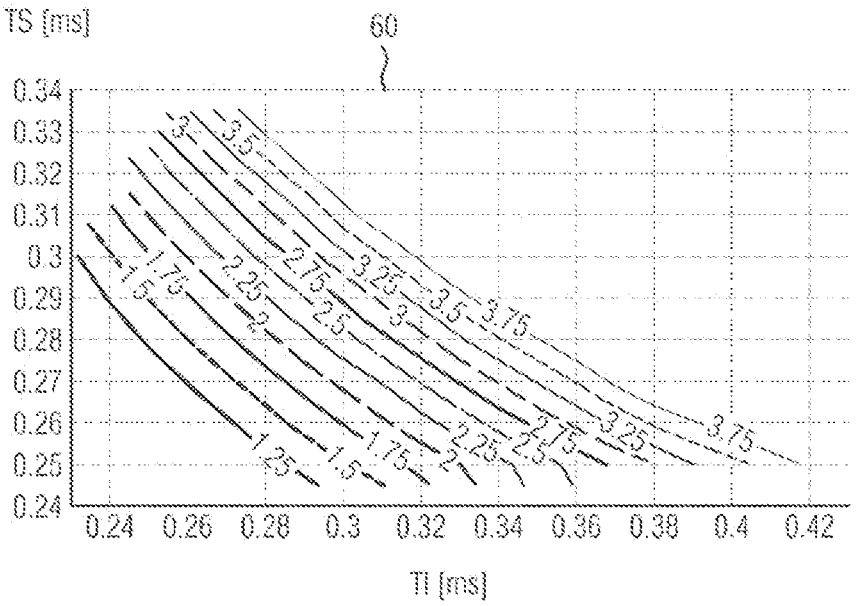
FIG. 6 shows an exemplary characteristic diagram according to an exemplary embodiment, according to teachings of the present disclosure.

FIG. 6 shows an exemplary characteristic diagram 60 according to an exemplary embodiment. The characteristic diagram 60 was acquired by acquiring iso lines for constant fuel quantities from the illustration 50. In other words, each curve in the characteristic diagram corresponds to a constant injection quantity, in the example shown 1.25 mg, 1.5 mg, 1.75 mg, 2.0 mg, 2.25 mg, 2.5 mg, 2.75 mg, 3.0 mg, 3.25 mg, 3.5 mg and 3.75 mg. With a selected value of the actuation time TI and a measured value of the closing time (time duration of the closing process), the injection quantity is therefore easily obtained as the curve in the characteristic diagram 60 on which the point (TI, TS) lies. For example, with TI=0.3 ms and TS=0.25 ms an injection quantity of 1.5 mg is obtained. The characteristic diagram 60 forms the basis for the method as described below.

Figure 7:
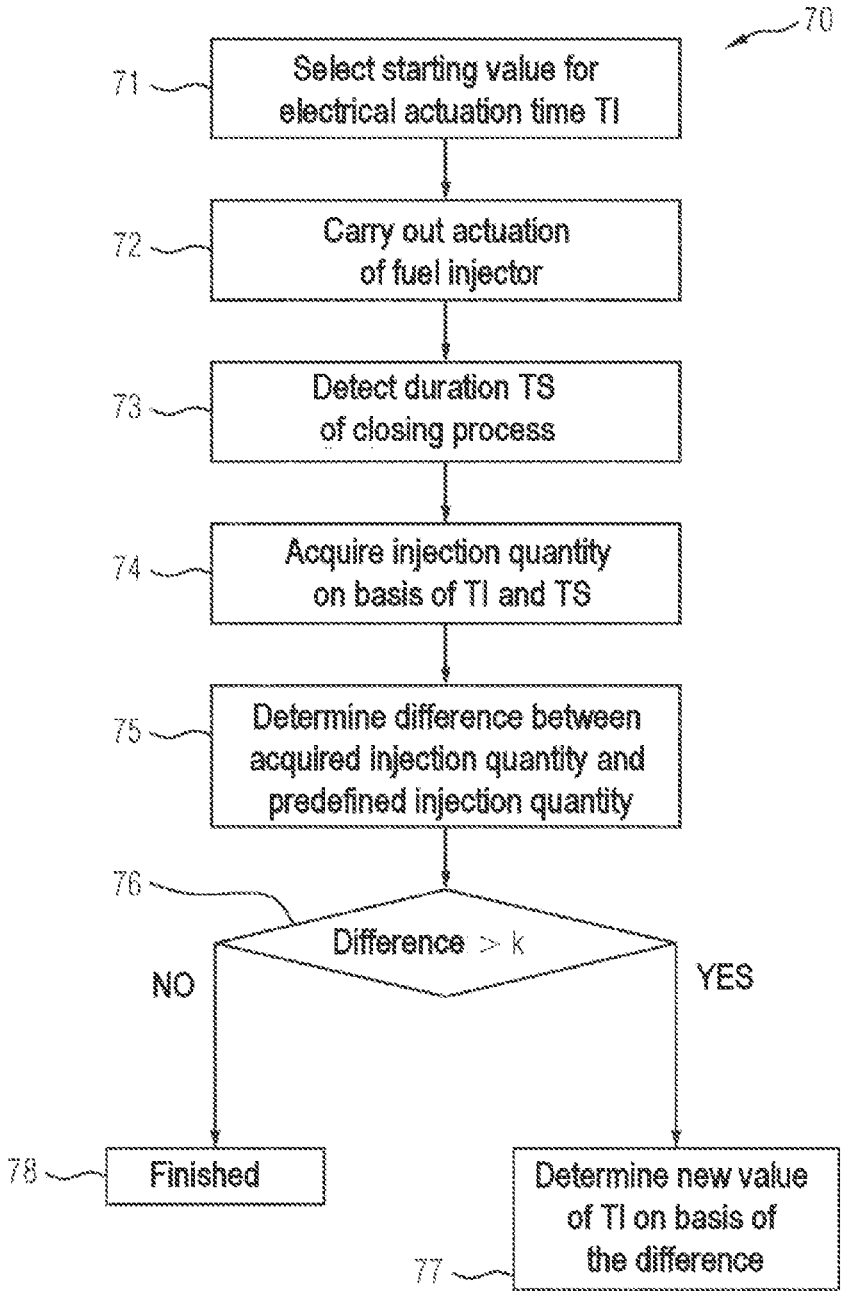
FIG. 7 shows a flowchart of a method, according to teachings of the present disclosure.

FIG. 7 shows a flowchart 70 of a method for determining a value of an electrical actuation time for actuating a fuel injector 1 with a solenoid drive 3 and 4 in order to obtain a predefined injection quantity. The method 70 begins in step 71 with the selection of a starting value of the electrical actuation time TI on the basis of the predefined injection quantity. In other words, a value is selected here for the electrical actuation time TI with which the predefined injection quantity should be obtained if all the varying properties and variables of the fuel injector have the corresponding standard values.

In step 72, an actuation process of the fuel injector 1 with the selected starting value of the electrical actuation time TI is carried out, and in step 73 the time duration TS of the closing process (closing time) is detected during the actuation process of the fuel injector 1 with the starting value of the electrical actuation time.

On the basis of the selected starting value of the electrical actuation time TI and the acquired closing time TS, in step 74 the actual injection quantity is now acquired using the characteristic diagram 60.

In step 75, the difference between the acquired injection quantity and the predefined injection quantity is then calculated.

In step 76, it is then determined whether the difference is greater than a predetermined threshold value k.

If this is the case, in step 77 a new value for the electrical actuation time TI is determined on the basis of the difference. More specifically, the new value of the electrical actuation time TI is determined using the characteristic diagram 60. With this new value for TI, the method now returns to step 72 in which a renewed actuation process of the fuel injector is carried out with the new value of the electrical actuation time TI.

If it is determined in step 76 that the difference is less than or equal to the predetermined threshold value k, the method 70 is ended at 78. The last value of the electrical actuation time then provides the predefined injection quantity with the precision defined by the threshold value, and can consequently be used to actuate the fuel injector during operation.

It is to be expressly noted that the above description merely constitutes one of many possible embodiments. In particular, significantly more complex embodiments are also possible which have, for example, a combination of various functions and/or regulators. The relationship shown in FIG. 4 could e.g. also be used for an add-on for a closing time regulation process if it is used to determine the opening time (OPP1) instead of the injection quantity.

LIST OF REFERENCE SIGNS

1 Fuel injector
2 Pole piece
3 Armature
4 Coil
5 Nozzle needle
6 Spring
7 Coil housing

21 Voltage profile
22 Current profile
31 Injection rate profile
32 Injection rate profile
33 Injection rate profile
40 3D illustration
50 3D illustration
60 Characteristic diagram

What is claimed is:

1. A method for actuating a fuel injector with a solenoid drive to obtain a predefined injection quantity, the method comprising:

setting a starting value of an electrical actuation time, the electrical actuation time representing a duration for which an electrical voltage is applied to the solenoid drive, based at least in part on the predefined injection quantity;

actuating the fuel injector with an electrical actuation pulse for the duration represented by the starting value;

detecting an elapsed time for a closing process, the elapsed time equal to an amount of time required for the fuel injector to physically close after an end of the electrical actuation pulse;

determining an injection quantity from the starting value and the detected elapsed time;

determining a difference between the injection quantity and the predefined injection quantity; and determining a corrected value of the electrical actuation time based at least in part on the determined difference using a relationship between the electrical actuation time, the time duration of the closing process, and the injection quantity; and using the corrected value to control a second actuation of the fuel injector.

2. The method as claimed in claim 1, further comprising:

during the second actuation of the fuel injector with the corrected value, detecting a second time duration (TS) of the closing process;

acquiring a second injection quantity on the basis of the corrected value and the second time duration;

determining a second difference between the acquired second injection quantity and the predefined injection quantity; and determining a second corrected value of the electrical actuation time on the basis of the determined second difference.

3. The method as claimed in claim 2, further comprising:

determining whether the second difference is greater than a predetermined threshold value; and determining the corrected value only if the second difference is greater than the predetermined threshold value.

4. The method as claimed in claim 1, wherein:

the relationship is represented by a characteristic diagram comprising a multiplicity of curves, each with a constant injection quantity;

the electrical actuation time is specified along a first axis; and the duration of the closing process is specified along a second axis.

5. The method as claimed in claim 1, wherein the actuation process of the fuel injector is carried out in a ballistic operating mode.

6. The method as claimed in claim 1, wherein the actuation process of the fuel injector is carried out in a linear operating mode; and the method further comprises acquiring a value of a needle stroke for the fuel injector, and selecting the characteristic diagram from a multiplicity of characteristic diagrams on the basis of the acquired value of the needle movement.

7. The method as claimed in claim 1, further comprising:

acquiring the value of an idle stroke for the fuel injector; and selecting the characteristic diagram from a multiplicity of characteristic diagrams on the basis of the acquired value of the idle stroke.

8. A method for actuating a fuel injector having a solenoid drive, the method comprising:

obtaining a predefined injection quantity, setting a starting value of an electrical actuation time, the electrical actuation time representing a duration for which an electrical voltage is applied to the solenoid drive, based at least in part on the predefined injection quantity;

actuating the fuel injector with an electrical actuation pulse for the duration represented by the starting value;

detecting an elapsed timed of a closing process, the elapsed time equal to an amount of time required for the fuel injector to physically close after an end of the electrical actuation pulse;

determining an injection quantity based on the starting value and the detected elapsed time;

determining a difference between the determined injection quantity and the predefined injection quantity; and determining a corrected value of the electrical actuation time based at least in part on the determined difference using a relationship between the electrical actuation time, the time duration of the closing process, and the injection quantity; and actuating the fuel injector with the corrected value of the electrical actuation time.

9. An engine controller for a vehicle, the engine controller comprising:

a processor in communication with a memory;

the memory storing a set of instructions, the instructions, when executed by the processor, causing the processor to:

set a starting value of an electrical actuation time, the electrical actuation time representing a duration for which an electrical voltage is applied to the solenoid drive, based at least in part on a predefined injection quantity;

actuate the fuel injector with an electrical actuation pulse for the duration represented by the starting value;

detecting an elapsed timed of a closing process, the elapsed time equal to an amount of time required for the fuel injector to physically close after an end of the electrical actuation pulse;

determine an injection quantity using the starting value and the detected elapsed time;

determine a difference between the injection quantity and the predefined injection quantity; and determine a corrected value of the electrical actuation time based at least in part on the determined difference using a relationship between the electrical actuation time, the elapsed time, and the injection quantity; and use the corrected value to control a second actuation of the fuel injector.

* * * * *